United States Patent [19]

Schulze

[11] Patent Number: 4,462,145

[45] Date of Patent: Jul. 31, 1984

[54] METHOD OF MAKING A PORTABLE AND COLLAPSED STRUCTURE

[76] Inventor: Herbert C. Schulze, P.O. Box 6070, Incline Village, Nev. 89450

[21] Appl. No.: 237,118

[22] Filed: Feb. 23, 1981

[51] Int. Cl.[3] ..... B23P 19/00

[52] U.S. Cl. ..... 29/428; 29/450; 29/453; 40/610; 446/112; 116/63 T; 264/295; 428/7

[58] Field of Search ..... 116/63 T, 209; 428/31, 428/8, 7, 9, 12, 542.2, 542.8; 40/616, 610; 29/434, 526 R, 453, 450; 264/295; 46/21, 31

[56] References Cited

U.S. PATENT DOCUMENTS

| | | | |
|---|---|---|---|
| 490,680 | 1/1893 | Roberts | 428/542.8 X |
| 1,880,130 | 9/1932 | Goldbach | 428/542.8 X |
| 2,057,942 | 10/1936 | Fay | 46/31 X |
| 2,483,734 | 10/1949 | Neal | 116/63 T |
| 2,935,238 | 5/1960 | Koehler | 428/542.8 X |
| 2,965,376 | 12/1960 | Kessler | 46/21 X |
| 3,042,050 | 7/1962 | Finlayson | 428/12 X |
| 3,320,225 | 5/1967 | Bradbury | 264/295 X |
| 3,322,093 | 5/1967 | Goland et al. | 40/610 |
| 3,359,657 | 12/1967 | Hedberg | 46/31 X |
| 3,454,694 | 7/1969 | Delaire et al. | 264/295 X |
| 3,485,202 | 12/1969 | Platt | 116/63 T |
| 3,666,607 | 5/1972 | Weissman | 428/542.8 X |
| 4,159,112 | 6/1979 | O'Brian et al. | 46/31 X |

*Primary Examiner*—Charlie T. Moon

[57] ABSTRACT

This invention is a structure encompassing a large volume of area used for traffic delineators, warning and instruction signs, and the like. It is characterized by being formed from materials specially formed and hinged in such manner as to be collapsible for storage and transport when not in use. The structure and the method involved comprises a multiplicity (preferably three) of flat items hinged together in an angular relationship to one another when assembled, to encompass a large volume, but at the same time, so as to collapse into a single flat configuration for storage and transportation, by folding two panels to opposite sides of a center panel.

4 Claims, 43 Drawing Figures

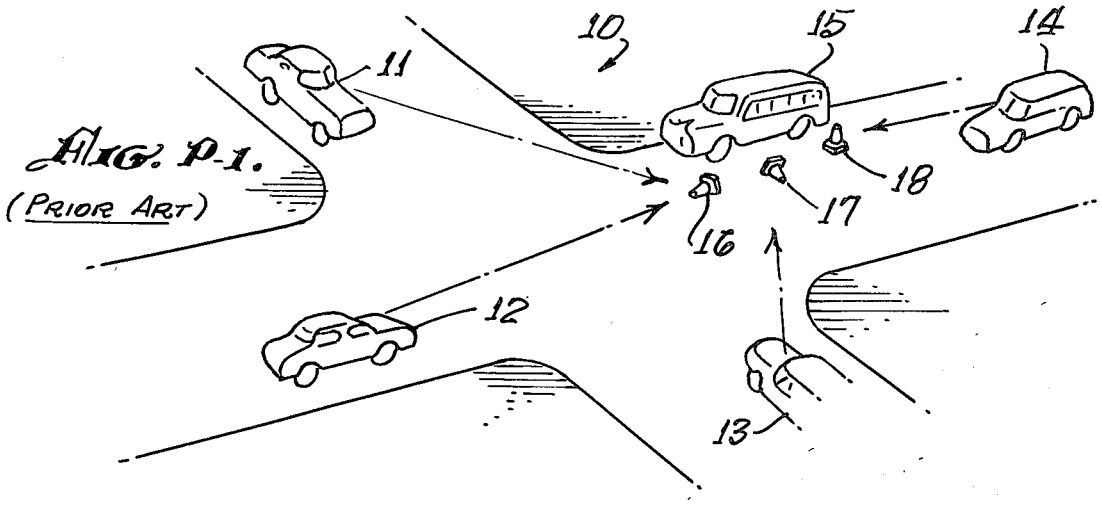
FIG. P-1.
(PRIOR ART)
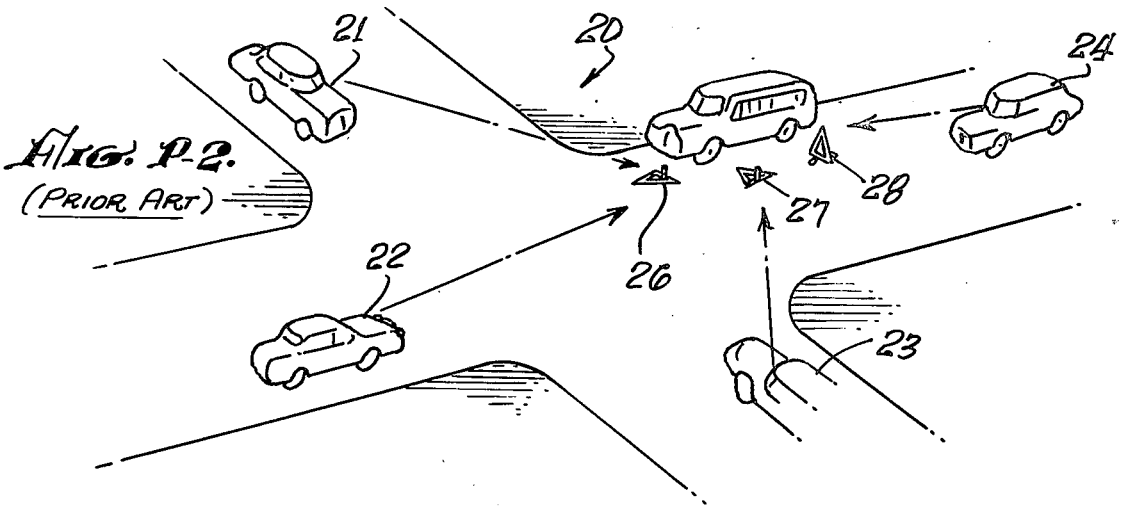
FIG. P-2.
(PRIOR ART)
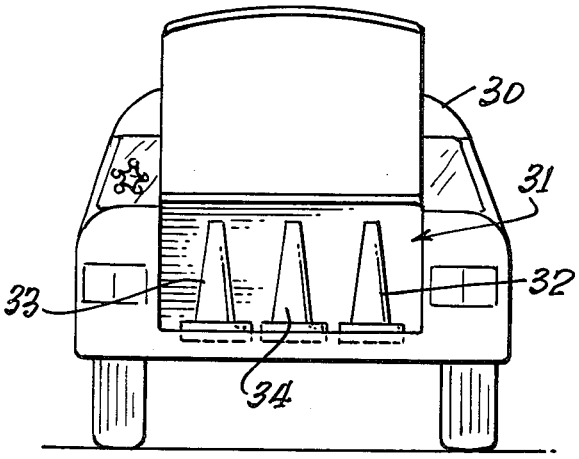
FIG. P-3
(PRIOR ART)
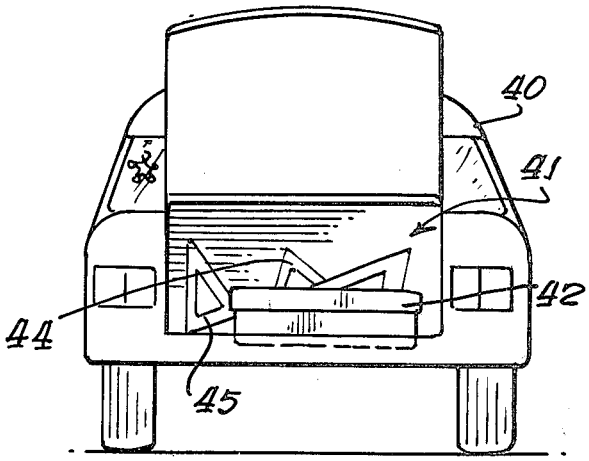
FIG. P-4
(PRIOR ART)

101
100
105
104
108
107
106
102
103

117
125
116
110
119
118
113
112
114
115
111

110
113
111
118
112

50
51
110
110
110

117a
117
115
115a
110
114
114a
112
116
116a
6
111
118
6
119
113

FIG. 14.
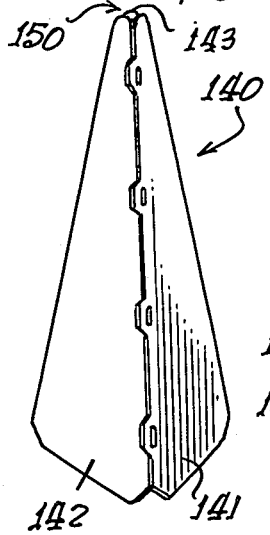
FIG. 15.
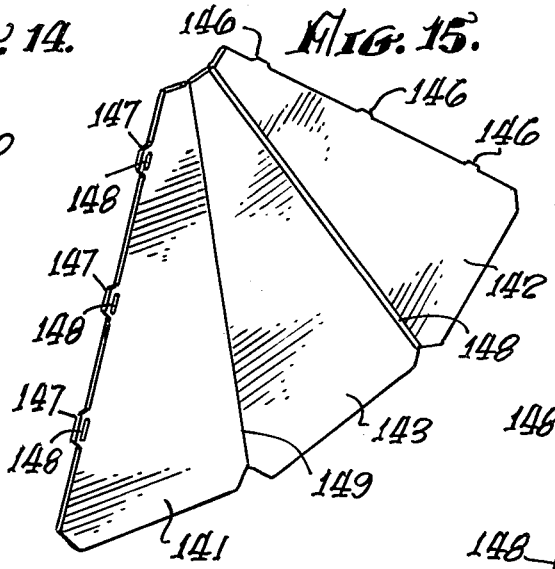
FIG. 16.
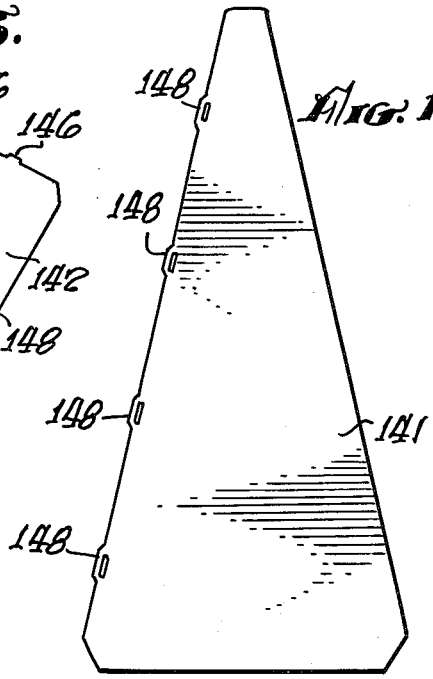
FIG. 18.
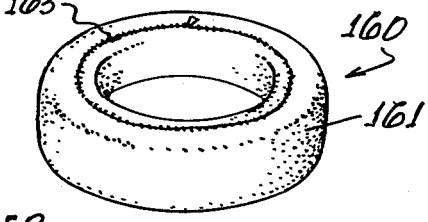
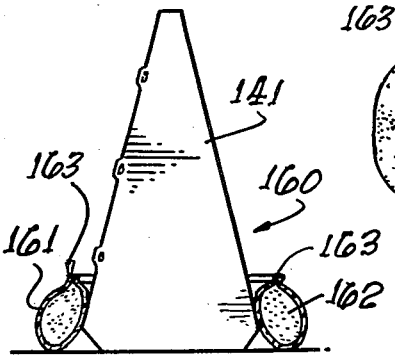
FIG. 17.
FIG. 20.
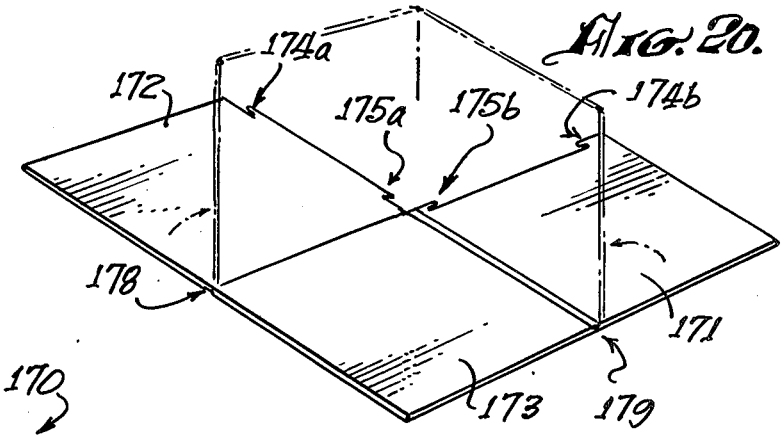
FIG. 19.
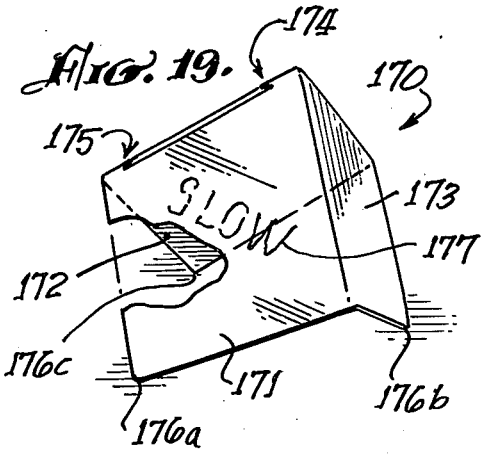
FIG. 21.
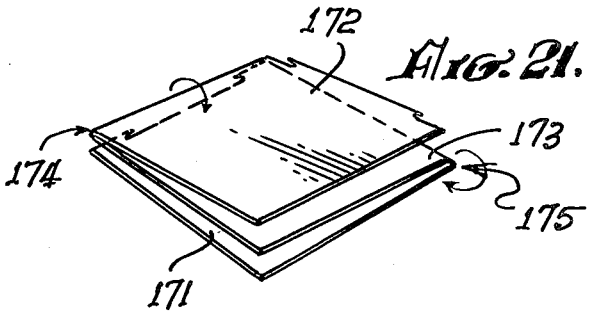

SLOW
SLOW

METHOD OF MAKING A PORTABLE AND COLLAPSED STRUCTURE

CROSS REFERENCE TO RELATED PATENT APPLICATIONS

This application is related to my seven design patent applications being filed concurrently herewith, now Ser. Nos. 06/237,119; 06/237,120; 06/237,244; 06/237,245; 06/237,375; 06/237,374; and 06/237,373, all filed in the U.S. Patent Office, Feb. 23, 1981 all of which are now abandoned except for Ser. No. 06/237,374 which is now U.S. Pat. No. D270820, issued Oct. 4, 1983 and Ser. No. 06/237,245 which has been allowed and is now U.S. Pat. No. D273,095, issued Mar. 20, 1984. This application might be considered by some as related to my co-pending application Ser. No. 06/119,572 filed Feb. 7, 1980, now abandoned, only in the sense that both applications pertain to structures which are collapsible and may be used in some of the same fields of application. However the inventions disclosed are entirely distinct and in that sense unrelated.

BACKGROUND OF THE INVENTION

1. Field of the Invention

This invention is in the general field of articles in the form of structures encompassing larger volumes than those occupied by their exposed areas and thickness of members specifically encompassing the exposed areas, and is more particularly directed to such articles for use primarily to delineate traffic lanes, define boundaries of an area, or to communicate instructional or other messages; It is further directed to such articles in the form of multi-sided units, and it is even more particularly directed to such articles formed of panels connected together in a hinged relationship in such manner that the panels can be folded flat together to define a single basic two dimensional shape having only a third dimension equal to the thickness of the total of the thickness of the individual panels, which may be opened from one another along their hinged areas and connected along one edge of two of the panels of each article in such manner as to form a large volume encompassing article. The invention is further directed to a method for making and using the articles heretofore described.

2. Description of the Prior Art

There is no prior art directed to the method nor the apparatus of this invention. My co-pending patent application Ser. No. 06/119,572 filed Feb. 7, 1980, now abandoned is in no manner even remotely prior art, since it does not hinge adjacent panels and is only related to a collapsible outer framework arrangement.

THE SUMMARY OF THE INVENTION

Whenever anyone finds himself or herself on travels in modern society, he or she finds himself directed, cautioned, or instructed by large and small, and permanent and temporary visual signs and other articles which may be for guidance, separation, directional control, instruction, and multitudes of communication purposes.

In our present society, such articles are provided for warning of "wet floors", "obstacles", "advertising", "rule inforcement", and for almost every conceivable instructional or guidance purpose for human (and animal) activities.

There are so many signs, delineators, warning devices and the like, that it is impossible to list them all. However, until the present invention, each and everyone of these devices for the various pruposes comprises a permanently or temporarily installed space consuming device or rather fixed construction, such as "traffic poles", "traffic cones", "barricades", "signs", "protective curtains", and the like. Most of these are cumbersome, unstable and supported (if at all) by complex mountings and the like.

Permanently installed items of the nature being described have inherent problems themselves, but they do not have problems of the consequence of the temporary articles of this nature. Such temporary articles include all of the foregoing categories, but particularly in traffic control and the like, they are very critical. A fallen sign or delineator can create confusion and accidents. This, of course, is in addition to the failure of the article to be performing the function for which it was originally intended.

The problems of the existing devices have been observed by almost everyone. The so-called "traffic cones", "poles", "barricades", and the like will frequently be observed to by lying upon the ground and not standing in an upright position. The same situation is true as to "wet floor", "caution", "flooded", and the like, signs. Additionally, it is very common to see such devices and signs crushed and destroyed by having been run over by vehicles.

In the transport of such articles another difficulty exists. Because of the large volume of space encompassed by many of the devices (traffic cones, delineator poles, signs, and their supports, and the like) ordinary vehicles are incapable of carrying sufficient of such articles to perform a proper task of warning, or the like, when required.

Studying this problem and experimenting for a long period of time, including the experiments which led to the conception and utilization of the devices as described in my co-pending patent application Ser. No. 06.119,572, filed Feb. 7, 1980, now abandoned, what will be the ultimate in this field (it is believed) has now evolved.

I have conceived, and invented, and developed an entirely new structure founded upon the basic principle of a folding tetrahedron structure. Many of the articles which I am now able to construct on this new theory do not look like tetrahedrons, but, if sufficient projection is made, each turns out to be fundamentally a tetrahedron structure and each, although not looking like a tetrahedron, has the great advantage of the tetrahedron's stability under all adverse conditions. Some of the devices have added unusual and unique characteristics unto themselves. All contain the great advantage of the tetrahedron structural theory.

Understanding the present heavy attacks which are made upon many patent applications in the U.S. Patent Office on a frequently applied "obvious under 35 U.S.C. 103 basis" I am reciting herein that this invention as disclosed has been discussed and reviewed thoroughly with such outstanding and acknowledged experts as Phillips Petroleum Comapny, Technibilt, Inc., Minnesota Mining, Inc., Crawford Industries and others. In each case the result has been the same. That result is that this item is unique and had not and would not have occurred to anyone with whom I have discussed it. In fact, to arrive at this result, has taken many years of study and experimentation, and it has taken a full year since the filing of my heretofore referenced patent application Ser. No. 06/119,572 filed Feb. 7, 1980 now abandoned before it had reached the point of perfection upon which this application can be filed.

The result of all of this work has been a device which can be used for virtually any type of instructional warning or communication providing unique and easily transported and stored characteristics with a much larger area of visibility (target area) than has ever heretofore been achieved as compared to the very small space required by devices utilizing this method and construction.

It can be seen then, that what has been sought and has been found, is a device providing a relatively large volumetric displacement with a much larger sight, or target area, but with a greatly reduced volume for storage and transport. Also, the particular structures and methods herein make ease of assembly and disassembly a key factor, which can be accomplished by virtually any individual having the absolute minimal physical strength and mental skill.

Further it has been my purpose, which has been accomplished, to provide such devices and the methods involved therein, wherein stability in use is superior to other items heretofore designed, conceived, or accomplished, for temporary or portable message conveying devices, and the like, of the type described.

It is an object of this invention to provide portable message conveying devices;

A further object of this invention is to provide such portable message conveying devices as described which occupy the minimum volumetric space in storage for the macimum volumetric space occupied in use;

Another object of this device is to provide such message conveying devices as heretofore described as are possessed of maximum stability in use;

Another object of this invention is to provide such devices as heretofore described which can be assembled and disassembled easily and conveniently without special skills or strengths.

Another object of this invention is to provide such devices as heretofore described which are virtually indestructable.

The foregoing and other objects and advantages of this invention will become apparent to those skilled in the art upon reading the description of a preferred embodiment which follows in conjunction with the appended drawings.

A BRIEF DESCRIPTION OF THE DRAWINGS

FIG. P-1 is a schematic perspective of a road intersection with various vehicles and hazards utilizing warning devices according to the prior art;

FIG. P-2 is a schematic perspective of the same scene as FIG. P-1 but with different type prior art warning devices;

FIG. P-3 shows, schematically and perspectively, an automobile carrying heretofore used "traffic cones";

FIG. P-4 is a view as FIG. 3, but showing the use of heretofore available warning triangles;

FIG. 14 illustrates in perspective another embodiment of an article employing the methods and theories of this invention in its assembled form;

FIG. 15 is a perspective plan view showing the elements of the article of FIG. 14;

FIG. 16 is a plan view of the article of FIG. 14 in its stored condition;

FIG. 17 is a partially sectioned side elevation of the apparatus of FIG. 14 utilizing a stabilizing device;

FIG. 18 is a perspective of the stabilizing device utilized in FIG. 17;

FIG. 19 is a perspective of an alternate embodiment of an essentially "diamond"- shaped sign as is used in much roadwork, which sign embodies the method and apparatus of this invention;

FIG. 20 Illustrates in perspective plan view the item of FIG. 19 in a completely opened condition;

FIG. 21 is a perspective plan of the item of FIGS. 19 and 20 in its completely folded configuration for storage and transport;

DESCRIPTION OF A PREFERRED EMBODIMENT

Figure 1:
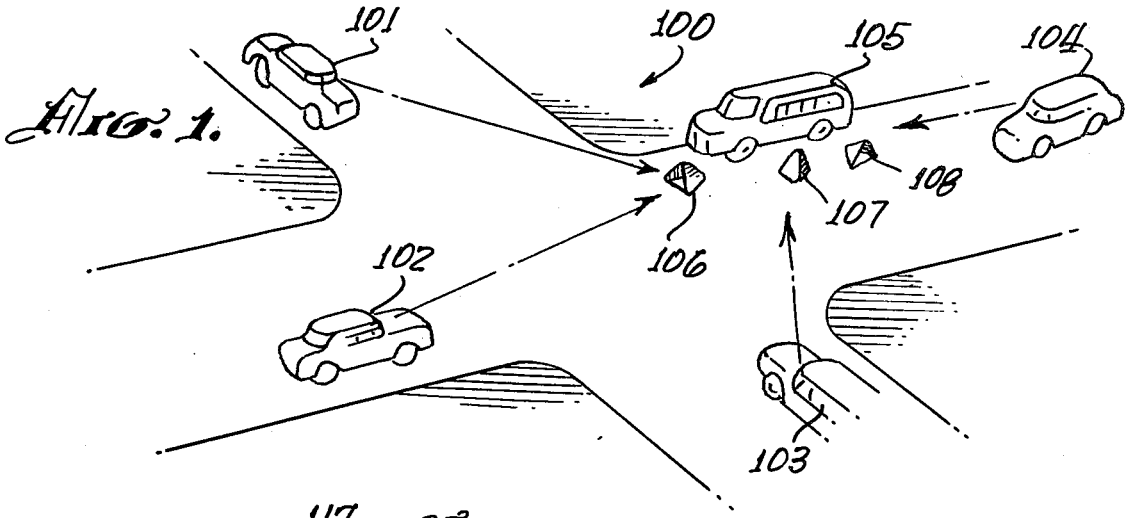
FIG. 1 is a schematic perspective of a road intersection as in FIG. P-1 with the same hazards, however utilizing warning devices according to the present invention.

Throughout the following description of a preferred embodiment, it will be noted in examining the drawings that sometimes, for clarity and convenience of drawings, the scale has been changed in successive drawing illustrating the same identical item. Rather then give separate reference numerals to all of such changes of scale, it is to be understood that the items are the same when bearing the same reference numerals even though the scale has been changed and even if special remark may not have been made.

The first four Figures, FIGS. P-1, P-2, P-3, and P-4, are Figures illustrating devices previously existing in use under certain emergency circumstances. The reason for these illustrations is to clearly compare the devices of the present invention and their advantages under such circumstances as illustrated in the FIGS. P-1 through P-4.

FIG. P-1 shows a road intersection, generally 10, having one disabled vehicle 15, and four vehicles 11, 12, 13, and 14 moving in different directions toward the area of the disabled vehicle. Three customary traffic cones, 16, 17, and 18 have been placed on the roadway for purposes of attempting to warn oncoming traffic of the existence of the disabled vehicle. As is customary with such cones, they are easily turned over and in illustration shown two of the cones 16 and 17 have been turned over and thus do not give a clear indication of the danger to vehicles 11, 12, and 13. Vehicle 14 would be the only one which would be seeing a clear representation of the warning device in an upright condition.

In FIG. P-2, a similar situation to that depicted in FIG. P-1 is shown. In this case, the road intersection generally 20, has a similar disabled vehicle 25 and moving vehicles 21, 22, 23 and 24. Three heretofore existing somewhat collapsible triangular warning devices, 26, 27 and 28 are shown. Again, as is common because of road conditions, and the like, the two warning devices 26 and 27 have fallen over. Thus, once again, three of the vehicles, 21, 22, and 23 do not have a clear warning of the hazard, although vehicle 24 will probably have a fair warning.

In FIG. P-3, an automobile 30 having a trunk space 31 is illustrated. Three customary cones, 32, 33 and 34 are shown in the trunk of the vehicle and it is seen the rather large amount of space they occupy. Such cones can, of course, be stacked one upon the other but still occupy a great amount of space and so stacked sometimes will become too long an element to fit within the trunk space.

FIG. P-4 shows three triangles 43, 44, and 45 of the type in the illustration of FIG. P-2 together with a carrying box 42 for the triangles in the trunk 41 of vehicle 40. It is recognized that these triangular warning devices may be somewhat folded and placed within the box 42. This is a cumbersome operation, and one which many untrained persons or those whose fingers may be not fully operative due to arthritis, or the like, find most difficult, and frequently the condition shown is that condition in which these items will exist taking up a great deal of the available trunk space.

FIG. 1, shows a road intersection 100 similar to that shown in FIGS. P-1 and P-2 with a disabled vehicle 105 and four moving vehicles 101, 102, 103, and 104. In this case, three warning articles 106, 107, and 108, of the method and device of this invention are shown. In this illustration two of the devices, 106 and 107 are actually turned over although as indicated in the drawings they appear to have essentially the same warning configuration and they give the same full warning to all of the vehicles, whether turned over or not. This will be better understood by examining FIGS. 2 and 3.

Figure 2:
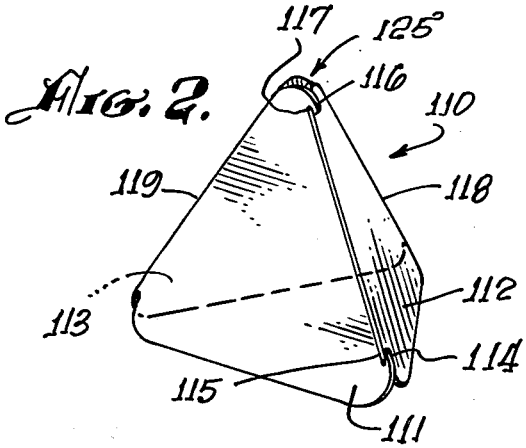
FIG. 2 is a perspective of a preferred embodiment of an apparatus to practice the method of this invention in its assembled and fully space occupying configuration.
Figure 3:
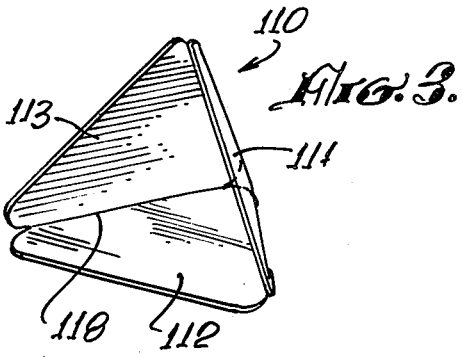
FIG. 3 is a view similar to FIG. 2, but with the device of FIG. 2 having been turned over.

FIGS. 2 and 3 both illustrate a device 110 of this invention and being the same type device utilized as 106, 107 and 108 in FIG. 1.

The device 110 is shown to consist of three fundamentally triangular panels 111, 112 and 113. Panel 111 is hinged in a manner described in more detail below, at 119. Panel 112 is likewise hinged to panel 113 along hinge area 118. The joining edge between panel 111 and 112 is held together by the interlocking connecting ears 114, 115, 116 and 117 in the manner which is described below and illustrated in more detail in following figures.

It will be observed that all of the corners of the triangular panels have been rounded. This is not absolutely essential, but one big advantage of rounding the corners in this manner, and an advantage with which it is felt is a sub-invention as opposed to the condition if there were straight triangular corners coming together sharply, is that because of this rounding an opening is formed at 125. When several of these devices are in use, they can be most easily handled by placing one or two fingers within the opening at 125 and a thumb or other fingers on the outside. The item is easily carried by its top in this manner, and where desired, being carried and handled this way, the item in its assembled condition can be stacked with other similar items by placing one over the other.

Carefully examining FIGS. 2 and 3, it will be noted that there is very little difference between the appearance of the device in the two figures. Yet, the view and "target" seen even when the device is turned over as it is in FIG. 3, is almost identical to the view, target, and impression when seen in its correct upright position in FIG. 2. This great advantage makes it relatively unimportant if a vehicle hits one of the devices or for some other reason it turns over. It still acts as a fully effective warning device.

Figure 4:
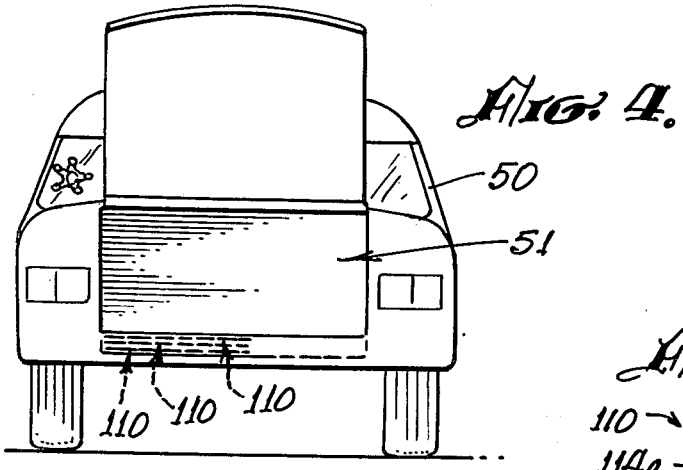
FIG. 4 is a view similar to FIG. P-3 or P-4 but showing devices of this invention (FIG. 2–3) stored in a vehicle.

FIG. 4 shows three of the devices 110 in their completely folded condition (as is described in detail below) and stored position within the trunk area 51 of a vehicle 50. It will be noted that they take such a small amount of space that they are not even visible from a direct rear elevation. Thus, they do not even interfere at all with any luggage space or the carrying of other articles. The manner in which they fold will be clear when the entire description is revealed below.

Figure 5:
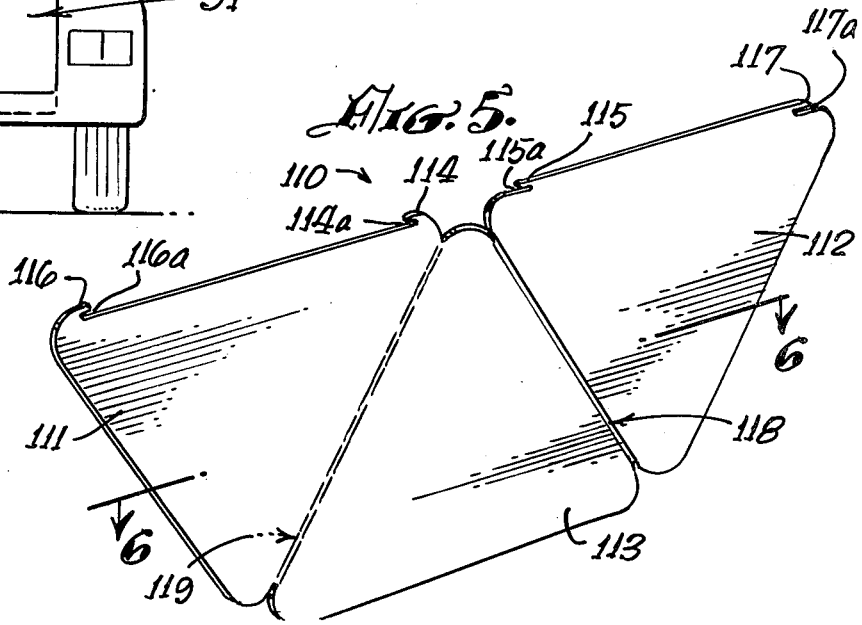
FIG. 5 is a perspective of the device of FIGS. 2 and 3 in a fully opened condition.

FIG. 5 illustrates the device 110 of FIGS. 2 and 3 wherein the edges of panels 111 and 112 have been disconnected from one another and it is seen that the entire item lays out as a flat item. Panel 111 is hinged to panel 113 and panel 112 is hinged to panel 113 as indicated. The interlocking arrangement between panels 111 and 112 on their edges is accomplished by the interconnecting ears and slots 114, 114*a*, which interconnect with 115 and 115*a* and similar elements 116 and 116*a* which interconnect with 117 and 117*a* in the manner illustrated in more detail below.

Figure 6:
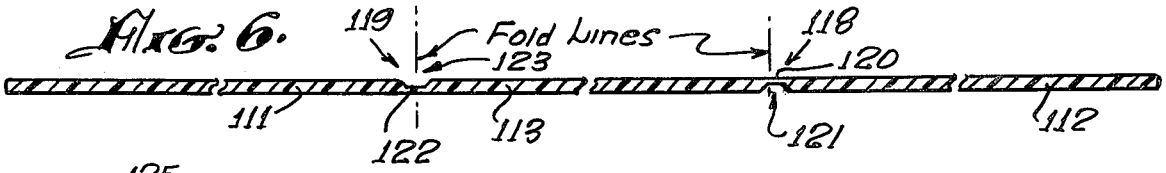
FIG. 6 is a section on 6—6 of FIG. 5.

FIG. 6 which is a section on FIG. 5 shows particularly the two hinge areas 118 and 119. It will be observed that the hinge area 118 comprises a thin piece of material connecting panels 112 and 113 with a groove or the like, at 121. Likewise, a thin area 122 exists between panels 111 and 113 with a groove 119. It should be. especially observed that the two thin areas are on opposite sides of the panels.

At this point it is important to notice that the device 110 has been made from one single sheet of material. This can be made from many different materials, but it appears that perhaps the most desirable material is polyethylene. Polyethylene has many advantages for a device of this nature and it is felt that conceivably the use of polyethylene in itself is patentable when its features are combined for the purposes as described throughout.

Among other things, the device 110 being made of polyethylene can utilize an extremely effective and economical method of forming the two hinge areas 118 and 119. By pressing on those hinge areas with a rod or a bar, the thin area may be formed with a great deal of extra strength. Pressing the thin area in this manner causes it to be formed on one side as is desired and seems to strengthen the material. It will be understood that in order to form this a round bar or the like, is placed on the polyethylene which in turn is on a hard flat surface. A powerful press, then presses the bar down into the polyethylene until it is pressed almost all the way through.

Figure 10:
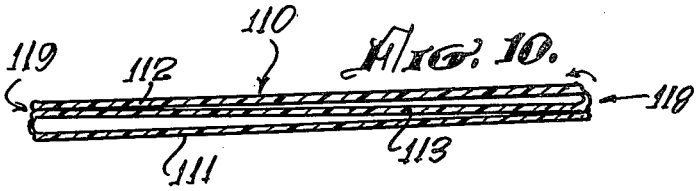
FIG. 10 is a section on 10—10 of FIG. 9, after the device has been fully folded into its flat condition.

When the pressure is released, the reduced area where the bar was pressing into the polyethlyene will remain and by flexing the material over the area of reduced thickness a hinge-like area is formed. Such a hinge is sometimes referred to as a "living hinge". It has great strength and can be flexed repeatedly. By pressing one hinge from one side and one hinge from the other side, the panel 111 can fold flat against panel 113 one one side and the panel 112 will fold flat against 113 on its other side. This is illustrated in FIG. 10 below.

It is to be understood that three separate panels could be used, but it would be important that the hinging between the three separate panels be such that panel 111 can fold flat against one side of panel 113 and panel 112 fold flat against the other side of panel 113 to achieve the maximum effeciency of storage in the smallest available space in the folded condition.

Figure 7:
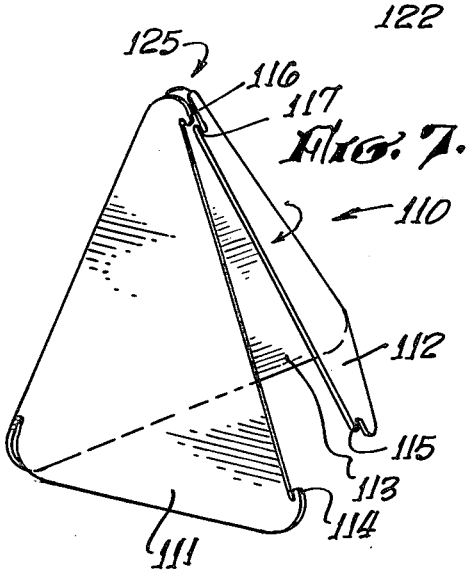
FIG. 7 is a perspective illustrating the device of FIG. 5 being prepared for assembly into a space occupying structure.
Figure 8:
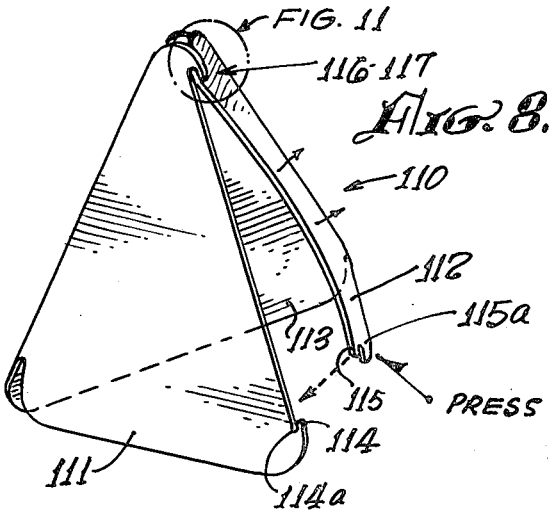
FIG. 8 is a perspective illustrating the method of fastening elements of the device of FIGS. 5, 6, and 7 into assembled position (or the unfastening thereof)

FIG. 7 illustrates one of the devices 110 in the process of being assembled from the flat condition. The ear 116 and the ear 117 will be hooked together and the ear 114 and 115 will be hooked together. In FIG. 8 the ears 116 and 117 are in fact, hooked together, and the manner in which ears 115 and 114 will be hooked together is illustrated. In this case the panel 112 is being flexed by pressure against the edge adjacent the ear 115. The ear 115 will then be interconnected with the ear 114 and the pressure released so that the material in panel 112 will return to a straightened and unflexed condition thus the ears 116, 117, 114 and 115 will hold each other together. In order to fully understand the interlocking of these ears, reference is made to FIG. 5 wherein it is shown that the ear 116 is formed by making a slot, or notch 116*a*. The ear 114 is likewise formed in a similar manner with slot 114*a* and ear 115 has its slot 115*a* and ear 117 has its slot 117*a*.

Figure 9:
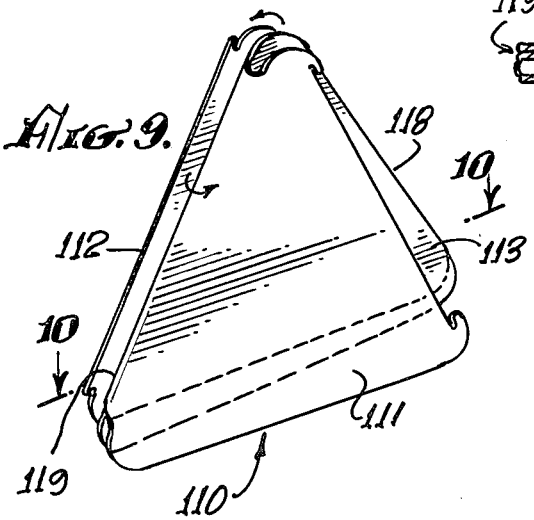
FIG. 9 is a perspective of the device of FIGS. 5, 6 and 7 being folded for storage.

After the device 110 has been assembled into the condition in which it is shown in FIG. 2 by the process of FIGS. 7 and 8, it may be opened up by once again pressing on the panel 112 in such manner as to cause it to flex and release the ears 114 and 115 from their interlocking arrangement then release the ears 116 and 117 so that the device is again in the position shown in FIG. 7. At this time it can be now folded as shown in FIG. 9. FIG. 10 is a section on 10—10 of FIG. 9 and shows the completely flattened device ready for storage.

Figure 11:
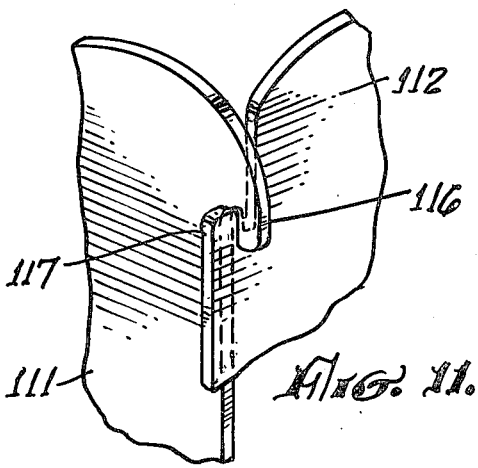
FIG. 11 is a fragmentary perspective of two hooking elements which create the interlocking catch illustrated.

FIG. 11 is a fragmentary greatly enlarged view of the area 11 on FIG. 9. This shows in complete detail the manner in which two ears 117 and 116 interlock with each other. It is understood that the ears 114 and 115 will be interlocked in a similar manner when the device is in its assembled condition.

Figure 12:
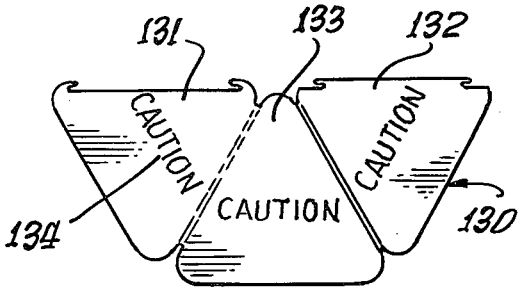
FIG. 12 is a plan view of one side of a device similar to that shown in FIG. 5 but with printing utilized on one side.

FIG. 12 shows a device 130 of the same structure as device 110 and in the opened condition shown in FIG. 5 but with a sign or legend on each panel. In this case the legend CAUTION 134, is shown on each of the three panels 131, 132 and 133.

Figure 13:
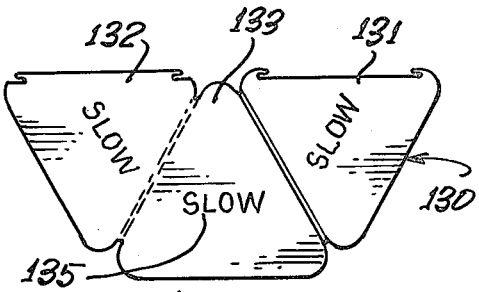
FIG. 13 is a plan of the other side of the article of FIG. 12 showing different printing which can be placed thereon.

FIG. 13 illustrates the reverse side of the panels shown in FIG. 12 and a different slogan 135, in this case SLOW has been shown. Thus, it is seen that one of these devices can actually carry two different slogans if desired and can be used for two different types of warning situations. The interlocking ears as previously described work equally well from either direction, thus all sides of the devices made this way are usable.

FIGS. 14, 15, 16 17 and 18 should be viewed together, and show an alternate embodiment of an apparatus according to the method of this invention. The space encompassing device 140 is shown assembled in FIG. 14 and it is noted is in the shape of a tetrahedron, but not an equilateral tetrahedron. The three panels 141, 142, and 143 are hinged at 149 and 148 in a manner similar to the embodiment heretofore shown and described in FIGS. 7, 8, 9, and 10 of this application. FIG. 15 shows the three panels with their hinge areas and FIG. 16 illustrates the device in plan view in its completely folded, for storage, condition.

In the form shown in the FIGS. 14 through 18, it will be noted that a different connection is used between the edges of panels 142 and 141 where they join in assembled configuration. In this case, tabs 146 are provided along the edge of panel 142 and tabs 147 are provided along the edge of panel 141. Each of the tabs 147 has a slot 148 suitable to accommodate and hold, by friction, the appropriate tab 146. It is to be recognized that the closure method as illustrated particularly in FIG. 11 and the other FIGS. of the former embodiments can also be used, and conceivably other means of fastening this edge together could be utilized.

FIGS. 17 and 18 in connection with this embodiment illustrate a device suitable to stabilize this apparatus, if desired, under extreme wind, or other adverse conditions. The ring-like element 160, comprises a suitable casing 161, of plastic, canvas, or the like, and a weighted filling 162, of sand, or other suitable material. For ease of transport, the device can be made with a zippered, or other closure 163, into which local material such as sand, dirt, stones, and the like, may be filled, and which may be then removed when the device is moved so the entire weighty device need not be carried. Thus, by the ability to easily use local materials for weighting, the ease of transport is further enhanced.

FIGS. 19, 20, and 21 illustrate an interesting alternate embodiment 170 of an apparatus employing the methods of this invention. It will be observed that three panels, 171, 172, and 173 are joined by an appropriate hinging arrangement in the configuration shown in FIG. 20 and utilizing hinge areas 178 and 179. The panels 172 and 171 are joined together by connections 175 and 174 similar to the connections utilized and shown in FIGS. 7 through 10. The individual connecting elements are indicated as 174*a*, 174*b*, 175*a* and 175*b* in FIG. 20.

When assembled in the condition shown in FIG. 19, the individual panels form a structure enclosure as indicated particularly in FIG. 19 wherein the panels rest upon the corners 176*a*, 176*b*, and 176*c*. When in this condition the assembled item is extremely stable, and even though it does not exactly give the appearance of a tetrahedron structure, it can be seen that it is in essence a tetrahedron structure. It is extremely stable and almost impossible to turn over.

It is observed that in spite of the advantage of the tetrahedron structure, the structure formed this way in the direction of any one of its faces, does not take up excess road space, but only uses the width across its widest point.

Under adverse terrain circumstances, it will be seen that this three point resting of the device gives a completely stable structure. This apparatus has the further advantage that it may be folded in both directions in its assembled condition the same as the two previous embodiments illustrated. Thus, six actual face areas are available for signs or cautionary slogans such as illustrated at 177 on one panel in FIG. 19.

Even though this structure may be extremely large as the largest highway signs, it still folds for maximum transportability in the manner shown in FIG. 21.

If it is desired to compensate for the sloping face which will be present to an oncoming motorist or the like, the panels can be made in an elongated configuration so that a projection will illustrate a perfectly otherwise "square" diamond-face, or for what other unusual purposes may be desired.

Figures 22, 23, 24, 25, 26, 27, 28, 29, 30:
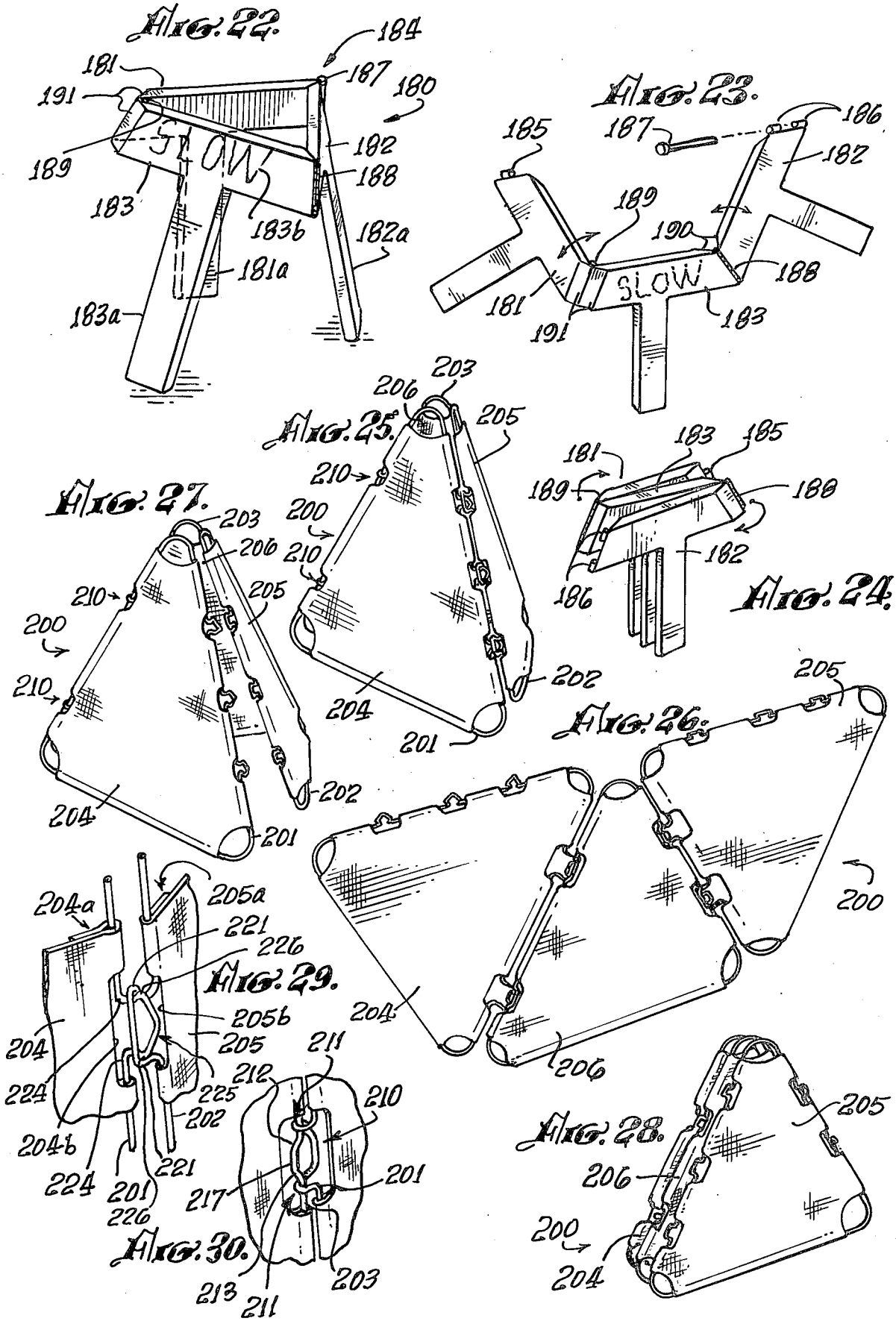
FIG. 22 is a perspective of another alternate embodiment of a device embodying the methods and apparatus of this invention, in this case, an item such as a road barricade, or the like, in its fully operational attitude.
FIG. 23 is a perspective plan view of the item of FIG. 22 in a completely opened posture.
FIG. 24 is a perspective plan of the article of FIGS. 22 and 23 in its completely folded attitude for storage and transport.
FIG. 25 is a perspective of an apparatus embodying the principles of this invention, but constructed of a framework of wire or the like, with a light covering thereabout in its completely assembled and space occupying use form.
FIG. 26 is a perspective plan view of the item of FIG. 25 completely flat and unfolded.
FIG. 27 is a perspective of the item of FIGS. 25 and 26 about to be fastened into the attitude of FIG. 25.
FIG. 28 is a perspective view of the item of FIGS. 25, 26, and 27, completely folded for transport and storage.
FIG. 29 is a partially broken away perspective of one of the fastening devices to hold the article of FIGS. 25 through 28 in its assembled and space occupying configuration.
FIG. 30 is a partially broken away perspective of a segment of the hinged areas between panels of the article illustrated in FIGS. 25 through 28.

FIGS. 22, 23, and 24 should be viewed together and they illustrate a most desirable embodiment utilizing the teachings and methods of this invention. In FIG. 22 the completed item 180, a barricade type device, is shown in its assembled functional condition. In the particular illustration shown one panel has a slogan "slow" 183*b*. Slogans of this nature may be utilized on this device although in general the device of this configuration will be most used with diagonal stripes to indicate the generally recognized barricade warning.

It will be observed that this item comprises three panels, 181, 182, and 183, each of which has an extension 181*a*, 182*a*, and 183*a*, as indicated. The extensions may be intregal parts of their respective barricade panels, 181, 182, and 183, or they may be separate and may merely be attached to those panels.

It will be noted that panel 181 hinges to panel 183 by hinge 189 and panel 182 hinges to panel 183 by hinge 188. The panel 181 and the panel 183 have their adjoining edges tapered, or chamfered, at 191 on the side opposite the side upon which the hinge 189 is mounted. This is necessary in order that the thickness, if formed of a thick material, of the individual panels will not prevent their closing into the configuration shown in FIG. 22. Likewise, the joint between panel 183 and panel 182 will he chamfered at 190 on the side opposite the hinge mounting side 188, for the same reason. In this manner, the panel 182 will fold for storage to one side of the panel 183 and the panel 181 will fold to the other side of the panel 183. The connection between panels 182 and 181 will preferably be by some simple connecting device such as a pair of ears, or the like 186, on panel 82 and a connecting ear, or the like 185, on panel 181. When they are brought together, the locking pin 187 can hold them in position. Obviously, other connections can be made at this point. It will be observed that on the edges of 182 and 181, which are joined, a chamfered arrangement has been provided so that the device may be assembled and locked into position with either side of the panels facing outward.

There are numerous advantages to the device of FIGS. 22, 23, and 24, not the least important of which is that once again it is observed that the stability of a generally tetrahedron shaped device (if only points of contact are utilized) is achieved. Additionally, with the three point connection to the ground or terrain upon which it is mounted unusual terrain conditions are easily accommodated. Further, obstacles are easily surrounded and a device of this nature may be placed over such sensitive areas as chuckholes, firehydrants, survey markers, and the like. The device still has the great advantage of folding as indicated in FIG. 24 for complete flat and maximum storage advantage.

FIGS. 25, 26, 27, 28, 29 and 30 should be viewed together. They illustrate a device, generally 200, once again embodying the methods of this invention, but with some particularly unique structural advantages. The device 200 comprises three panels, each of which is formed of a wire framework 201, 201, and 203 respectively. These wire frameworks are each covered with a plastic fabric, or other suitable covering material 204, 205, and 206. It is stated that the framework 201, 202, and 203 are wire, but it is understood a frame could also be made of other materials. It could be made of plastic rods, of wood, or of numerous other materials and shapes, but a wire or rod, for this frame is particularly economical. The frames 201 and 202 are each joined along one of their edges to one edge of the frame 203 as indicated. A simple method of hinging a connection of this nature is shown in detail in FIG. 30 wherein a loop 211 has been formed in a portion of the frame 201 with a second loop 211 in the same frame at a spaced distance therefrom and with a slightly distorted shape at 210 to complete an open area having two loops with spaces.

The frame 203 has been slightly distorted at 217 to provide two shoulders at 212 and 213. Thus, the wire frame 203 passing through the two loops 211 is held from longitudinal movement by this arrangement but will still pivot to fold flat when desired as shown in FIG. 27.

An arrangement similar to that illustrated in FIG. 30 will exist in one or more locations between the frames 201 and 203 and the frame 202 and 203.

The connection between frames 202 and 201 is likewise formed in a very simple manner. Although other connections could be used, it is particularly advantageous to form this connection as shown in enlarged detail in FIG. 29. In this case, the frame 201 is bent as at 224, in two places, to provide a loop of wire 225, with ears 226 which are insertable within and hold within the bent openings at 221 on frame 202. This construction is quite clear by viewing the drawing wherein the flexibility of the wire frames will allow the portion 225 to snap into position in the opening formed between the two bent areas 221. Thus, it will be held in its assembled condition as shown particularly in FIG. 25. Covering is adhesively fastened (204*a*,205*a*).

Figure 31:
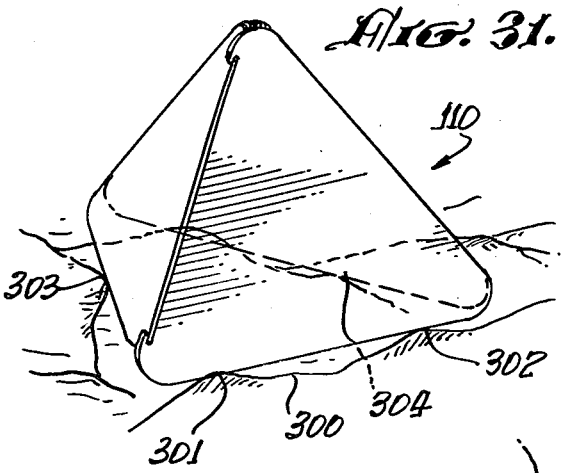
FIG. 31 is a perspective illustration of a device formed by the method and apparatus of this invention showing the ability to accommodate to any terrain.

FIG. 31 illustrates the device 110 previously shown in FIGS. 1 through 11 in place upon very uneven terrain. The advantages of the device are clearly shown since the ability to accommodate to virtually any terrain is so clear. The average, and heretofore used, devices for warning and instructional purposes, particularly of a temporary nature, will invariably have a multitude of support points and a uniformity of structure such that they tend to tip and fall over under any adverse terrain conditions. This apparatus is shown on an area having numerous high and low spots as 300, 301, 302, 303 and 304. It will be seen that because of this unusual and desirable tetrahedron shape any suitable three points will hold the device in a stable resting condition. The same principle of support holds for the embodiment shown in FIG. 14, the embodiment shown in FIG. 19, the embodiment shown in FIG. 22, and the embodiment shown in FIG. 25. Under all of these circumstances, ease of placement on bad terrain in one of the great advantages of this invention.

Figure 32:
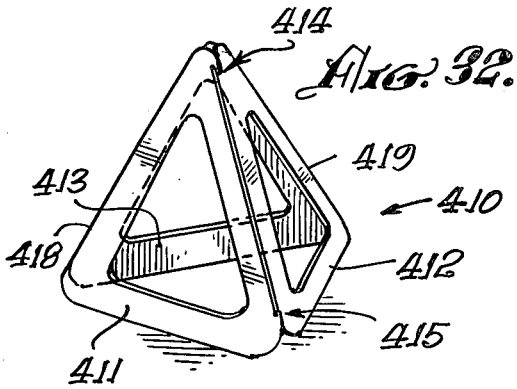
FIG. 32 is a perspective of an article embodying the principles of this invention wherein certain openings have been made within the panels defining an enclosure.

FIG. 32 illustrates essentially the same device as is shown in FIG. 31 except that it is formed more in the shape of a frame. The device, generally 410 has the same shape, but is formed of three open triangular members 411, 412 and 413, wherein number 411 is hinged to 413 at 418 and 412 is hinged to 413 at 419. These hinges will be hinges such as shown in FIGS. 6, 9 and 10, or in any other suitable manner to accomplish the purpose of having the ability to fold flat. The panels 411 and 412 when in assembled condition may be fastened at 414 and 415 by devices such as illustrated in FIGS. 7, through 11.

Figure 33:
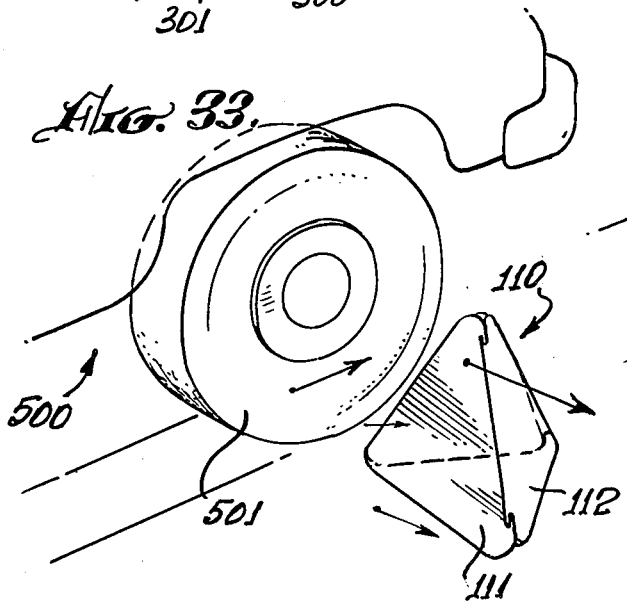
FIG. 33 illustrates the manner in which an article embodying the principles of this invention will "skid" out of the way, normally when hit by a vehicle.

FIG. 33 shows a partial view of a wheel area of a truck 500. In this case, the device 110 has been struck by the wheel 501 and is shown sliding or skidding out of the way on the roadway. This device, having the stable shape it has, does not require a flange around the edge to enable it to attempt to stay in an upright position. Thus, there is nothing for the truck wheel 501 to bear upon and the normal condition is as shown that it will just slide out of the way upon impact.

Figure 34:
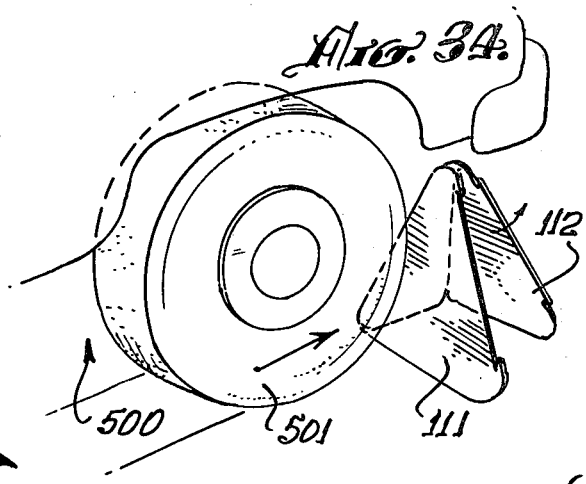
FIG. 34 is a partial perspective view showing how an article made by the method of this invention and embodying the principles thereof will normally disassemble itself upon being struck in a manner in which it cannot skid.
Figure 35:
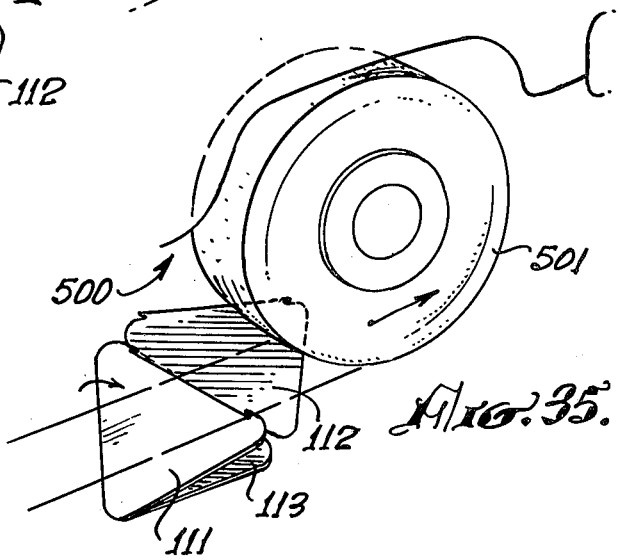
FIG. 35 is a perspective showing the effect of the passage of a vehicle wheels over an article of this invention.

FIG. 34 shows the same truck wheel 501 of FIG. 33 and the same device 110, but under slightly different circumstances. Under this circumstance, the device 110 has been struck in such manner, or with such force, that it does not actually slide out of the way. However, because of the manner in which it is connected in its assembled condition as shown in FIGS. 2, 7, 8, and 11, the edges of the panels 111 and 112 have, due to the shock, disconnected themselves. Thus, the item becomes disassembled and either lays out flat or folds wholly or partially. Under this circumstance, and as shown in FIG. 35, the truck wheel or the like, 501 has run over the device 110, but without harming it. The effect of running over a traffic cone under these conditions, or other devices heretofore utilized, however, is well known. They are generally completely destroyed by one such incident.

Figure 36:
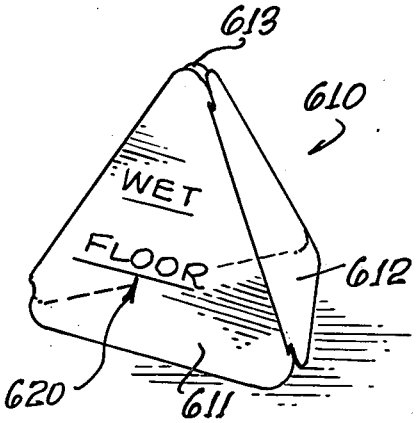
FIG. 36 is a perspective on a floor warning device constructed according to the methods and principles of this invention.

FIG. 36 illustrates a device 610 completely similar in construction to the device 110 heretofore described in detail. In this case, however, the device consisting of the three panels 611, 612, and 613 is shown to have painted on panel 611 at 620 a slogan, in this case "Wet Floor". It is to be recognized that a slogan, or a different slogan, may be painted on each of the six sides available (two sides per panel for three panels). Thus, one such device may serve for six individual signs if desired, understanding that if the same sign is desired for omnidirectional purposes then the three panels should have only one slogan, the same on each panel, on one side.

Figure 37:
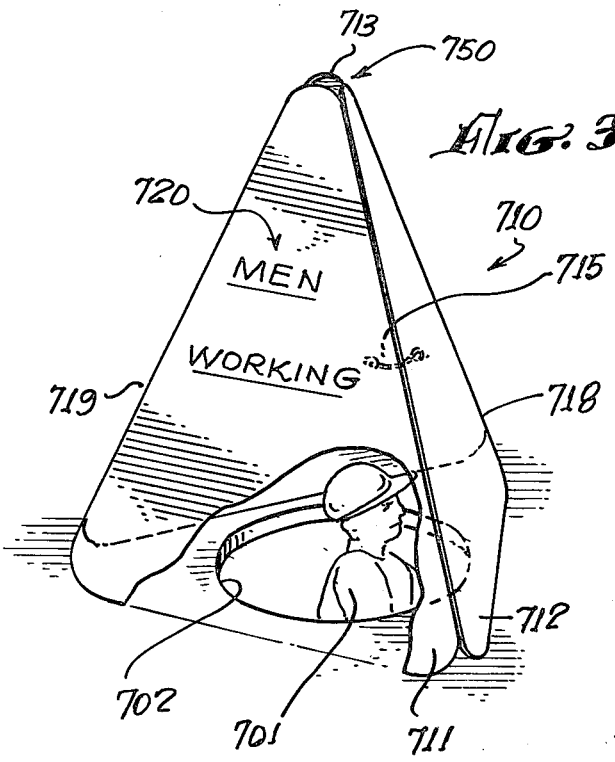
FIG. 37 is a perspective of a device constructed according to the teachings of this invention wherein a large sized unit covers a manhole or other work area.

An apparatus made according to the method and teaching of this invention may be made in virtually any size for special purposes. The unusual characteristics of the apparatus make it most desirable for temporary shelters of various kinds as well as for other purposes. FIG. 37 illustrates a large sized device made according to any one of the forms of this device heretofore illustrated. It would be particularly adaptable from a relatively light wire framework with a light covering, if desired, but solid panels or the like, may also be used. In this case the tetrahedron device 710 formed of the three panels 711, 712 and 713 and hinged at areas 718 and 719 as previously described for other embodiments shown is held in place by a simple catch or latch 715 as shown. Such a device can be used most advantageously for covering particular work areas such as a manhole work area 702, in which one or more persons 701 may be working. Appropriate slogan as at 720 may be shown. Such a device has the advantage over railings and the like presently used in that it completely shields the workman from view if desired, and in addition provides an easy and stable protective area covering which can be carried easily in its flat and stored condition on the side of a truck or the like, without occupying great space. It will be understood that panel 711 will fold flat against panel 713 on one side and panel 712 will fold flat against panel 713 on the other side in a manner similar to that shown for the previous embodiments.

Figure 38:
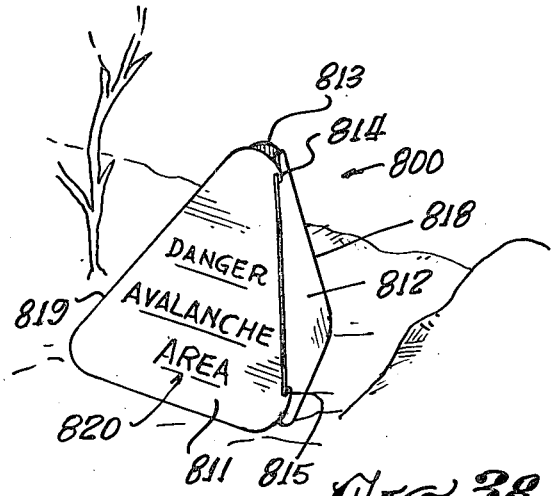
FIG. 38 is a perspective wherein a dangerous area under adverse terrain and weather conditions can be protected by utilizing the device according to this invention.

FIG. 38 shows one of the great advantages of a device according to the method of this invention, and particularly a device more or less in the configuration of the device 110 shown repeatedly through the drawings. In this case, such a device generally 800 is shown to consist of three panels 811, 812 and 813 hinged at 818 and 819 and fastened at 814 and 815 in a manner similar to the structure of the device 110 shown heretofore. Such a device, particularly if made of polyethylene or the like, will withstand all adverse weather conditions normally encountered, and can rest in snow, on ice, and uncertain terrain in a stable condition such as not heretofore realized by easily transportable portable warning devices.

Figure 39:
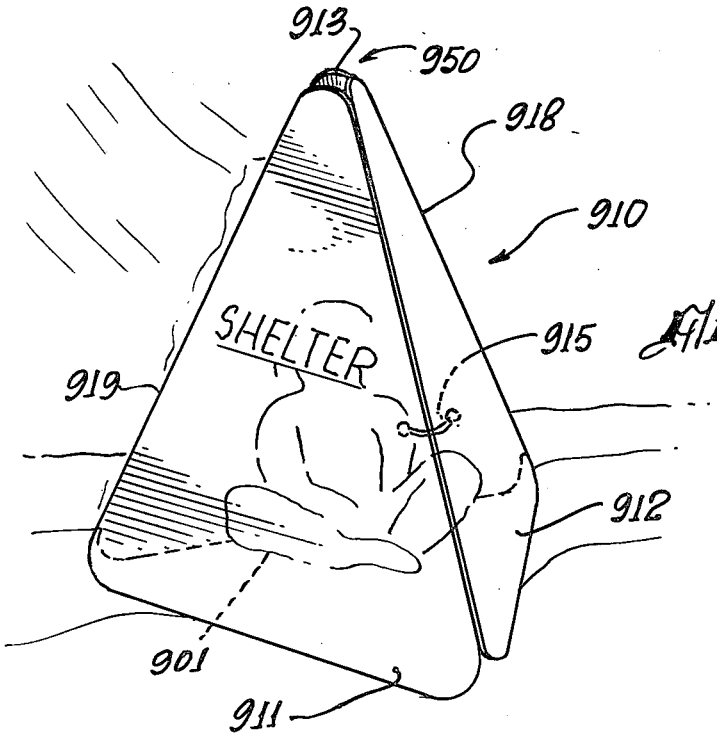
FIG. 39 is a perspective of a device according to the principles of this invention utilized for personnel protective purposes as a temporary shelter.

FIG. 39 illustrates a device made according to the method of this invention and it will be noted that this is quite similar to the device of FIG. 37. The device generally 910 of a large enough size to accommodate one or more persons is formed of three panels 911, 912, and 913 appropriately hinged at 918 and 919 and having a suitable catch or the like at 915 which can be operated from within by an individual. An opening at 950 is preferably provided to allow fumes and the like, to escape. The opening at 750 in the apparatus illustrated in FIG. 37 serves the same purpose.

The device 910 can be left in isolated areas in its folded condition where it takes up no particular space and can be maintained in good condition so that persons who may become lost may easily assemble the item and stay within it for shelter from the elements. This device can be made of a light framework of a fabric covering or may be of solid and strong panels. When severe snow or other conditions are to be expected, it is preferable that the device be made of strong and solid panels.

In the various descriptions herein the exact materials of which the various panels may be made, and their exact hinging methods have been suggested in a number of instances, but these are not controlling. The panels could, for example, be made of sheet metal or the like, appropriately hinged to accomplish the flat folding arrangement desired. They can also be made of wood, numerous plastics, and other materials. Likewise, the hinges can be of a wide variety such as the living hinge described as pressed into the polyethlyene device as illustrated as 110. Also the hinges may be piano hinges or customary strap hinges or the like, particularly in the embodiment of FIGS. 22 through 24. In connection with that particular embodiment, one additional point should be made and that is that the various specifications relating to barricades of this nature emphasize that the barricade portion (in this particular illustration the portion which bears the slogan "Slow")should be as prominent as possible with the framework detracting as little as possible from the direct exposure of the barricade itself. This has been accomplished extremely well in the particular embodiment of FIG. 22 since the three legs shown will occupy very little visual space to detract from the barricade portion itself. And, of course, an even smaller leg might be utilized for each of 181*a*, 182*a*, and 183*a* in FIGS. 22 through 23 depending on the material and strength desired.

While the embodiments of this invention shown and described are fully capable of achieving the objects and advantages desired, it is to be understood that such embodiments as have been shown and described are for purposes of illustration only and not for purposes of limitation.

I claim:

1. The method for forming a portable and collapsed structure as follows: (1) defining upon a sheet of material having a thickness a first triangular shape having a first, second and third edge, each of which edges is at an angular relationship to each of the other edges; (2) defining upon the same sheet of material a second triangular shape of substantially the same size and shape as the first defined shape, said second shape having a first, second and third edge, each of which edges is at an angular relationship to each of the other edges and wherein the second edge of the second shape is the same as the third edge of the first triangular shape; (3) defining a third shape of substantially the same size and shape as the first shape upon said sheet of material, said third shape having a first, second and third edge, each of which edges is at an angular relationship to each of the other edges and wherein the second edge of the third shape is the same as the third edge of the second shape; (4) reducing the thickness of the article upon one of its sides along the common line of the third edge of the first shape and the second edge of the second shape; (5) reducing the thickness on the other side of said article along the line defining the third edge of the second shape and the second edge of the third shape; (6) forming interengageable portions on the second edge of the first shape and the third edge of the third shape whereby said second edge of the first shape and third edge of the third shape are engageable to form a pyramidal body; (7) folding the first shape against the second shape along the side opposite the side where thickness has been reduced between the said first and second shapes; and (8) folding the third shape against the second shape along the side opposite the side where thickness has been reduced between the said second and third shapes.

2. The method of claim 1 wherein the two folds have been made along the two areas of reduced thickness and the said area of reduced thickness in each case is formed broad enough so that the said first and second shapes may be folded to a 60° relationship between one another on the side opposite the side where they are folded flat together and wherein said second and third shapes may be folded to a 60° relationship between themselves on the side opposite to the side where they were folded flat against one another.

3. The method of claim 1 wherein two essentially "U" shaped notches are formed into the second edge of the first shape with the legs of the "U" pointing away from each other and wherein the third edge of the third shape is formed so as to form two "U" shaped notches with their legs pointing toward one another and wherein the material adjacent to said third edge of the third shape between the interior of the legs pointing toward one another is formed in such manner that the "U" shaped notches on the second edge of the first shape and the third edge of the third shape may be interconnected by said "U" shaped notches.

4. The method of claim 2 wherein two essentially "U" shaped notches are formed into the second edge of the first shape with the legs of the "U" pointing away from each other and wherein the third edge of the third shape is formed so as to form two "U" shaped notches with their legs pointing toward one another and wherein the material adjacent to said third edge of the third shape between the interior of the legs pointing toward one another is formed in such manner that the "U" shaped notches on the second edge of the first shape and the third edge of the third shape may be interconnected by said "U" shaped notches.

* * * * *